US007041043B2

(12) United States Patent
Lucassen et al.

(10) Patent No.: US 7,041,043 B2
(45) Date of Patent: May 9, 2006

(54) CUSHIONING CONVERSION MACHINE AND METHOD WITH PLURAL CONSTANT ENTRY ROLLERS AND MOVING BLADE SHUTTER

(75) Inventors: Roger G. M. Lucassen, Bom (NL); Michel M. Spronk, Nieuwstadt (NL)

(73) Assignee: Ranpak Corp., Concord Township, OH (US)

( * ) Notice: Subject to any disclaimer, the term of this patent is extended or adjusted under 35 U.S.C. 154(b) by 559 days.

(21) Appl. No.: 09/453,480

(22) Filed: Dec. 9, 1999

(65) Prior Publication Data

US 2003/0040416 A1 Feb. 27, 2003

Related U.S. Application Data

(60) Provisional application No. 60/111,537, filed on Dec. 9, 1998.

(51) Int. Cl.
*B31B 1/00* (2006.01)

(52) U.S. Cl. ..... 493/464; 493/967

(58) Field of Classification Search ..... 493/464, 493/967; 242/421.5, 421.9
See application file for complete search history.

(56) References Cited

U.S. PATENT DOCUMENTS 3,799,039 A * 3/1974 Johnson
4,203,270 A * 5/1980 Forman ..... 53/133.7
5,056,293 A * 10/1991 Richards et al.
5,088,972 A * 2/1992 Parker
5,123,889 A * 6/1992 Armington et al.
5,213,867 A * 5/1993 Huston, Sr. et al.
5,558,923 A * 9/1996 Vesamaa
5,569,146 A * 10/1996 Simmons
5,713,825 A * 2/1998 Ratzel
5,943,844 A * 8/1999 Wilhelm et al. ..... 53/442
6,033,354 A 3/2000 Baumuller ..... 493/464

FOREIGN PATENT DOCUMENTS

EP 0888878 A2 1/1999
WO WO97/01434 1/1997
WO WO97/35798 10/1997

* cited by examiner

*Primary Examiner*—Eugene Kim
(74) *Attorney, Agent, or Firm*—Renner, Otto, Boisselle & Sklar, LLP

(57) ABSTRACT

A cushioning conversion machine and method for converting sheet stock material into a cushioning dunnage product with better control over the tension of the stock material fed into such machines for conversion into a dunnage product and better control over the dunnage product during a cutting operation to minimize the chance of a machine jam. The machine and method are characterized by a stock supply assembly that includes a plurality of constant entry guides at an upstream end of the machine for passage of respective plies of stock material thereover, a biased damper over which the multi-ply stock material can be trained before passage to constant entry guides, and a plurality of separators between the constant entry guides and the conversion assembly. Also disclosed is a severing assembly for severing the strip of cushioning to form a pad, which severing assembly includes a shutter movable with the moving blade for substantially blocking the strip path when the moving blade is in its extended position.

7 Claims, 5 Drawing Sheets

CUSHIONING CONVERSION MACHINE AND METHOD WITH PLURAL CONSTANT ENTRY ROLLERS AND MOVING BLADE SHUTTER

This application claims the benefit of provisional application No. 60/111,537, filed on Dec. 9, 1998.

FIELD OF THE INVENTION

The invention herein described relates generally to cushioning conversion machines and more particularly to improvements in controlling the tension of the stock material fed into such machines for conversion into a dunnage product and in controlling the dunnage product during a cutting operation to minimize machine jams.

BACKGROUND OF THE INVENTION

In the process of shipping an item from one location to another, protective packaging material is often placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and plastic foam peanuts is their affect on our environment. Quite simply, these plastic packaging materials are not biodegradable, and therefore they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a popular alternative. Paper is biodegradable, recyclable and composed of a renewable resource, making it an environmentally responsible choice for conscientious shippers.

While paper in sheet form could possibly be used as a protective packaging material, it is usually preferable to convert the sheets of paper into a relatively low density pad-like cushioning or dunnage product. This conversion may be accomplished by a cushioning conversion machine, such as that disclosed in commonly assigned U.S. Pat. No. 5,123,889. The conversion machine disclosed in U.S. Pat. No. 5,123,889 converts sheet stock material, such as paper in multi-ply form, into relatively low density pads. Specifically, the machine converts this stock material into a continuous unconnected strip having lateral pillow portions separated by a thin central band. This strip is connected as by coining along its central band to form a coined strip which is cut into sections, or pads, of a desired length. The stock material preferably consists of three superimposed webs or layers of biodegradable, recyclable and reusable thirty-pound Kraft paper rolled onto a hollow cylindrical tube. A thirty-inch wide roll of this paper, which is approximately 450 feet long, weighs about 35 pounds and will provide cushioning equal to approximately sixty cubic feet of plastic foam peanuts while at the same time requiring less than one-thirtieth the storage space.

The conversion machines known in the prior art, including the one shown in U.S. Pat. No. 5,123,889, have used a freely rotating roll from which the stock material to be converted is fed by means of the same mechanism that advances the material through the forming portion of the machine. Specifically a pair of gears that have performed a connecting operation have been used to advance the material being converted. These gears stop and start their rotation during the conversion process, and this results in the need to accelerate the stock roll every time the gears start, with resulting changes in the tension of material being fed through the conversion machine. These changes in the tension of the material can affect the quality of the dunnage product being produced.

Also, when the conversion process is stopped, the rotational inertia of the stock roll can cause the stock roll to overrun and form a loose loop of material at the supply end of the conversion machine. When the conversion process is resumed, initially the material will be at a relatively low tension until the loose loop of material is taken up, at which point the tension on the paper will rapidly increase, almost instantaneously, to a relatively high level until the stock roll accelerates to match the feed rate through the machine. This quick change in tension can cause the material to tear, as well as degrade the quality of the dunnage product being produced.

Another problem that arises from time-to-time in cushioning conversion machines of the aforesaid type are machine jams in the region of the severing assembly. A commonly used severing assembly includes a moving blade which travels between a retracted rest position and an extended full cut position. More specifically, a cutting cycle of the blade includes a cutting stroke during which the formed strip of dunnage is cut and a return stroke during which the blade returns to the rest position. During the cutting stroke, the moving blade unit travels across the dunnage outlet opening and cuts the dunnage strip into a cut section, or pad, of a desired length.

Although this cutting assembly is adequate to perform the cutting function, in certain situations the cut end of the continuous dunnage strip remaining in the cushioning conversion machine may interfere with the return stroke of the moving blade. If this interference is severe, the movement of the blade or subsequent feeding of the dunnage strip may be adversely affected to a point that a machine jam occurs. Although serious jams may be rare, they can result in mechanical damage. Misalignment of the trailing end of a cut pad has been previously addressed in U.S. Pat. No. 5,569,146. This patent discloses a cutting/aligning assembly that includes an automatic alignment device which automatically "re-aligns" the cut section with the outlet opening and a post-cutting guide chute during the return stroke of the moving blade unit. The alignment device seeks to insure a smooth transition for the cut section from the outlet opening through the post-cutting constraining assembly.

SUMMARY OF THE INVENTION

The present invention provides improvements in a cushioning conversion machine and method for converting sheet stock material into a cushioning dunnage product. These improvements enable better control over the tension of the stock material fed into such machines for conversion into a dunnage product and better control over the dunnage product during a cutting operation to minimize the chance of a machine jam.

According to one aspect of the invention, a cushioning conversion machine and method for converting multi-ply sheet stock material into a cushioning dunnage product, are characterized by a stock supply assembly which supplies stock material to be converted, and a conversion assembly which draws the stock material from the stock supply and converts the stock material into a strip of cushioning. In accordance with the invention, the stock supply assembly includes a plurality of constant entry guides at an upstream end of the machine for passage of respective plies of stock material thereover. In a preferred embodiment, the stock supply assembly includes a biased damper over which the multi-ply stock material can be trained before passage to constant entry guides, and a plurality of separators between the constant entry guides and the conversion assembly.

According to another aspect of the invention, a cushioning conversion machine and method for converting sheet stock material into a cushioning dunnage product are characterized by a stock supply assembly which supplies stock material to be converted, a conversion assembly which draws the stock material from the stock supply and converts the stock material into a strip of cushioning, and a severing assembly for severing the strip of cushioning to form a pad. In accordance with the invention, the severing assembly includes a moving blade mounted for movement across a strip path between a retracted position and an extended position for cutting the strip, and a shutter movable with the moving blade for substantially blocking the strip path when the moving blade is in its extended position. In a preferred embodiment, the shutter has an upstream surface flush with an upstream surface of the moving blade, and the shutter and moving blade are both mounted to a blade holder that is mounted for swinging movement relative to another blade that coacts with the moving blade to cut the strip.

The foregoing and other features of the invention are hereinafter fully described and particularly pointed out in the claims, the following description and the annexed drawings setting forth in detail one or more illustrative embodiments of the invention, such being indicative, however, of but one or a few of the various ways in which the principles of the invention may be employed.

DETAILED DESCRIPTION

Figure 1:
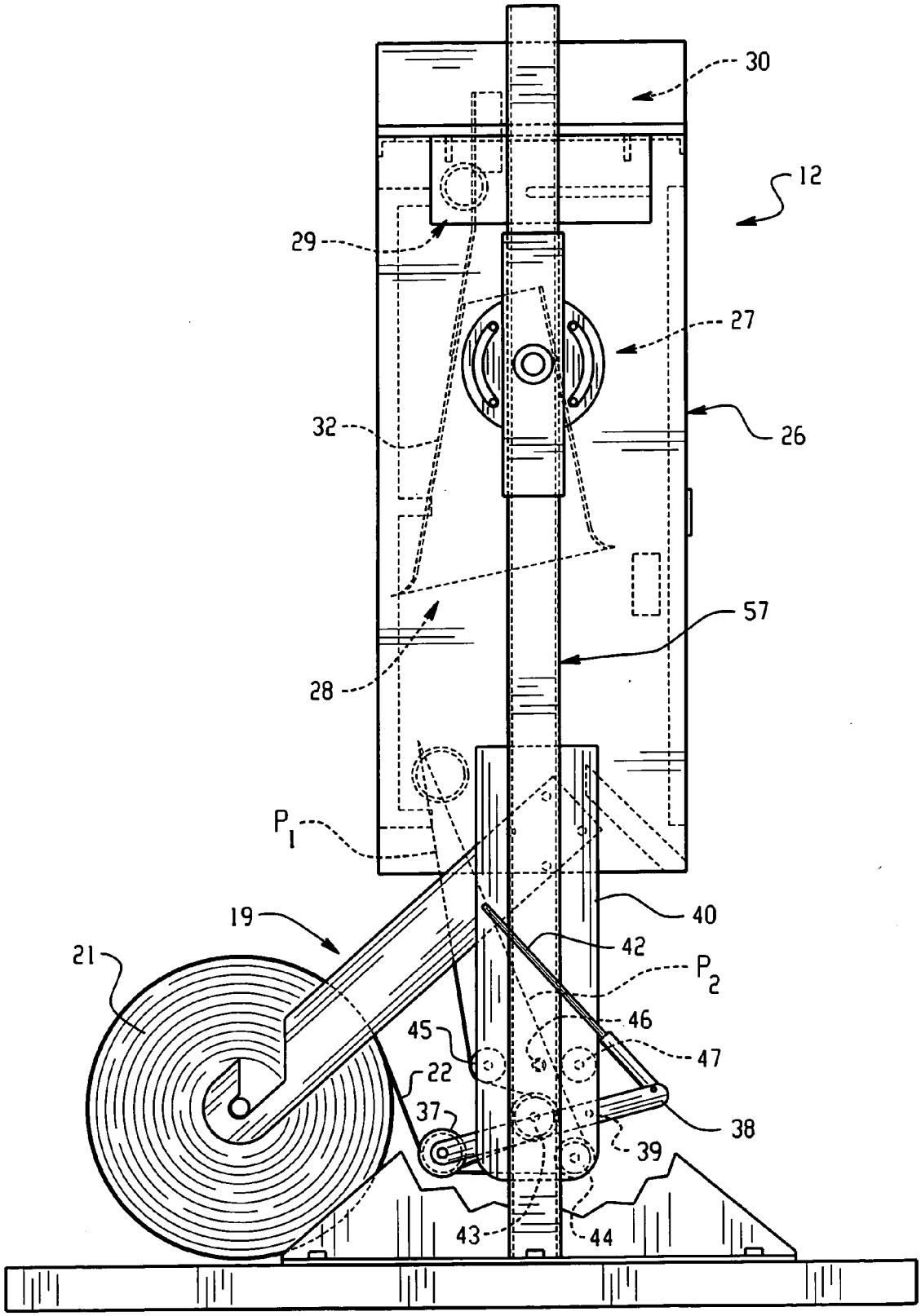
FIG. 1 is a schematic side elevation view of a dunnage conversion machine constructed in accordance with the present invention.
Figure 2:
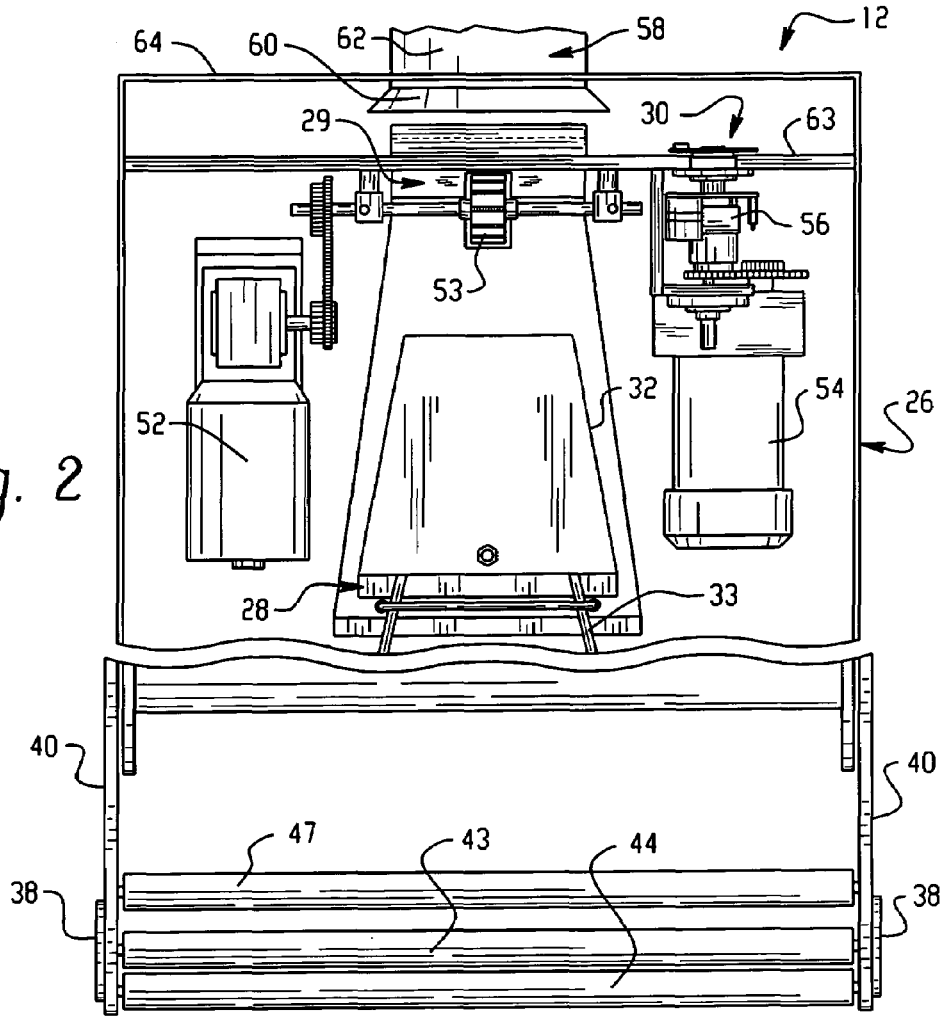
FIG. 2 is a plan view of the machine shown in FIG. 1, with a top panel thereof removed to permit viewing of internal components of the machine.

Referring now to the drawings in detail and initially to FIGS. 1 and 2, a preferred embodiment of a cushioning conversion machine 12 according to the present invention is shown. The conversion machine 12 has a stock supply which, in the illustrated embodiment, includes an integral stock roll holder assembly 19 for supporting a roll 21 of sheet stock material 22. Alternatively, the sheet material 20 may be supplied from a separate stand holding the sheet material, or by other suitable means.

The stock material 22 preferably consists of one or more, typically two or three, superimposed plies of biodegradable, recyclable and reusable sheet material, such as Kraft paper rolled onto a hollow cylindrical tube. As shown, two plies $P_1$ and $P_2$ are threaded into the machine. The machine 12 converts this stock material 22 into a crumpled strip of cushioning/dunnage (not shown). The machine 12 also has provision for severing, as by cutting, the strip to form a discrete pad of desired length, as is further discussed below.

The machine 12 generally comprises a housing 26 and a conversion assembly 27 that may include several sub-assemblies which form the pads. These sub-assemblies in the illustrated conversion machine include a forming assembly 28, a feed/connecting assembly 29, and a severing assembly 30, all of which are mounted in or to the housing 26. The illustrated forming assembly 28 includes a shaping chute 32 and a forming member 33 for forming the sheet material into a relatively thicker three-dimensional strip that is then connected by the feed/connecting assembly 29 to form the cushioning strip that is cut to length by the severing assembly 30.

During operation of the machine 12, the superimposed plies $P_1$ and $P_2$ of the stock material 22 pass from the stock roll 21 and around a damper roller 37 which is biased to exert a tensioning force on the stock material being fed into the machine. In the illustrated embodiment, the damper roller is journalled between the ends of pivot arms 38 that are pivotally attached at 39 to brackets 40 that in turn are attached to the rear end of the housing 26. The damper roller may be biased by gravity, although other biasing arrangements may be used such as the illustrated spring members 42 or other resilient spring biasing means. The spring members 42 are connected between the ends of the pivot arms opposite the damper roller and the brackets. The dancer roller swings about the pivot 39 of the pivot arms between the solid (37) and broken (37') line positions shown in FIG. 3 as the tension on the stock material is increased or decreased during unwinding of the stock material from the stock roll. This pivoting action, combined with the below discussed different ply paths, dampens the effects of starting and stopping of the stock material feed mechanisms (hereinafter described) and thereby assists in maintaining a more uniform tension on the stock material.

Figure 3:
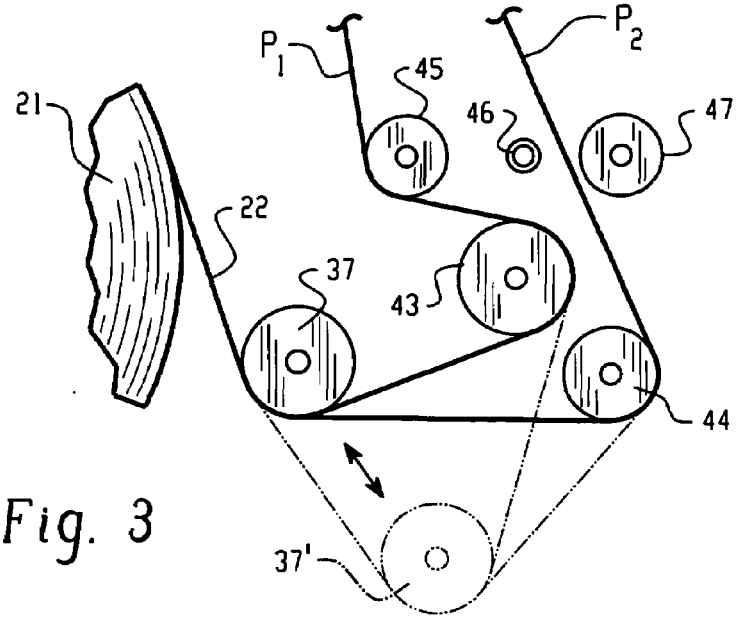
FIG. 3 is a schematic illustration showing the paths of plural plies of stock material at the upstream end of the machine.

After passage from the damper roller, the plies $P_1$ and $P_2$ of the stock material 22 are separated for passage to respective constant entry rollers 43 and 44 as best seen in FIG. 3, which rollers serve as constant entry guides for the respective plies. After passage over the constant entry rollers, the plies $P_1$ and $P_2$ pass between or around separators 45–47. The constant entry rollers and separators are mounted between brackets 40. In the case of two ply stock material, one ply $P_1$ passes to the outer side of the separator nearest the stock roll and the other ply $P_2$ passes between the other two separators. Preferably the outermost separators are larger in diameter than the innermost separator. Also, the outermost separators are only slightly smaller in diameter than the constant entry rollers.

The passage of the plies over respective constant entry rollers eliminates a problem that has been encountered in known conversion machines where the multiple plies are passed over a single constant entry roller and then separated for passage between or around separators. The frictional grip between the plies and the constant entry rollers aids in preventing overrunning problems. In some situations where the superimposed plies are passed over a single constant entry roller, the outermost ply may slip relative to the innermost ply, thereby allowing the outer ply to unwind and negating the retarding effect that the constant entry roller desirably has on the plies. This is avoided by passing the plies over their own respective constant entry roller after separation.

If three ply stock material is desired, then two of the plies may follow the same path around a constant entry roller while the remaining ply travels around the other constant entry roller. The middle one of the three plies will be contained between the two outer plies. Preferably, the middle ply travels over the higher one of the two constant entry rollers. After passage from the constant entry rollers, the inner ply will be separated from its companion ply and passed between the separators 45 and 46.

As just mentioned and illustrated in FIG. 1, the constant entry rollers 43 and 44 are at different elevations, i.e., closer and further from the conversion components 28 and 29 disposed within the machine's housing. Also, the pivot axis 39 of the damper roller pivot arms 38 is located proximately equal distance from the constant entry rollers and thus along a bisector between the constant entry rollers.

From the separators 45–47, the separated plies $P_1$ and $P_2$ pass to the forming assembly 28. The forming assembly causes inward folding of the lateral edges of the sheet stock material 22 to form a continuous strip having lateral pillow portions and a thinner central band portion. The feed/connecting assembly 29, which in the illustrated embodiment includes a pair of cooperating gear-like members 53, pulls the stock material 22 downstream through the machine and also connects the layers along the central band, as by coining and/or perforating in the illustrated preferred embodiment, to form a connected strip. As the connected cushioning strip travels downstream from the feed assembly 29, the severing assembly 30 cuts the strip into pads of a desired length. For further details of the illustrated and similar cushion-producing machines, reference may be had to U.S. Pat. No. 5,123,889 and published PCT Application No. US96/09109 and other issued patents and patent applications of Ranpak Corp.

The production of dunnage pads by the illustrated machine 12 may be controlled by a controller provided in the housing 26 or in a remote unit. For details of the general operation of the controller, reference may be had to U.S. Pat. Nos. 4,619,635 and 5,571,067 and to published PCT Application No. PCT/US95/09275, which are hereby incorporated herein by reference in their entireties. In pertinent part, the controller controls operation of a feed motor 52 which drives the feed components and particularly a pair of rotating gear-like members 53. The controller also controls operation of a cutter motor 54 and a clutch 56 which drives the severing assembly. Preferably, the cutter motor is continuously operated whereas control of the clutch controls the operation of the severing assembly. The functions of the controller may be carried out by a single processor device or by separate devices suitably interfaced to coordinate the operation of the feed motor, cut motor and clutch.

An exemplary pad produced by the illustrated machine 12 comprises the one or more plies of sheet material that have side portions thereof folded over the center portions thereof to form laterally spaced-apart pillow portions extending along the length of the pad. The pillow portions are separated by a central band where lateral edge portions are brought together. The lateral edge portions, which may be overlapped and/or interleaved, are connected together, and/or to underlying center portions of the plies along the central band. In a preferred form of cushioning pad, the connecting is accomplished by a combination of coining and stitching, the stitching being effected by perforations and/or cut tabs disposed along the central band. However, it will be appreciated by those skilled in the art that other types of conversion machines may be used to produce the same or other forms of cushioning strips. For further details of an exemplary pad, reference may be had to published PCT Application No. US96/09109, which is hereby incorporated herein by reference in its entirety.

The housing 26 of the conversion machine 12 has a longitudinal axis corresponding to the direction of passage of the sheet material downstream through the conversion assemblies from a rear or upstream end to a front or downstream end of the machine. The housing is generally rectangular in cross-section taken transverse to the longitudinal axis of the machine. The machine 12 may be supported in any suitable manner, for example upright, by a stand 57.

It is noted that the illustrated forming assembly 28 is of the type described in pending U.S. patent application Ser. No. 08/386,355 and similar to that shown in U.S. Pat. Nos. 5,123,889 and 5,674,172 all of which are hereby incorporated by reference. Other forming assemblies are also usable in the practice of the present invention, such as like the form shown in U.S. Pat. No. 5,674,172.

It is further noted that the above described damper and feed arrangement are particularly advantageous when feeding heavier weights of two ply stock material when the machine is in a vertical orientation, for example, two 70 grams/square meter ply kraft paper from a 400 meter stock roll (two 50 pound basis weight plies of kraft paper).

As seen in FIG. 2, a post-cutting (exit) guide chute 58 is provided downstream of the severing assembly 30. The guide chute 58 includes an upstream converging portion 60 and a downstream tunnel portion 62. The converging portion 60 is located between a downstream end plate 63 and an end wall 64 of the housing 26, while the tunnel portion 62 extends through and beyond the end wall 64. The guide chute 58 is positioned so that its inlet is aligned with a dunnage outlet opening 65 (FIG. 4) in the end plate 63 at which a pre-cutting guide chute terminates. Although not shown, the pre-cutting guide chute extends from a point upstream of the gear-like members 53 to the outlet opening 65, as is known in the art.

A cut pad will be urged or pushed downstream through the post-cutting guide chute 58 by an approaching dunnage strip. The converging portion 60 smoothly urges the pad into the tunnel portion 62. As the pad passes through the tunnel portion 62, it is generally constrained circumferentially.

Figure 4:
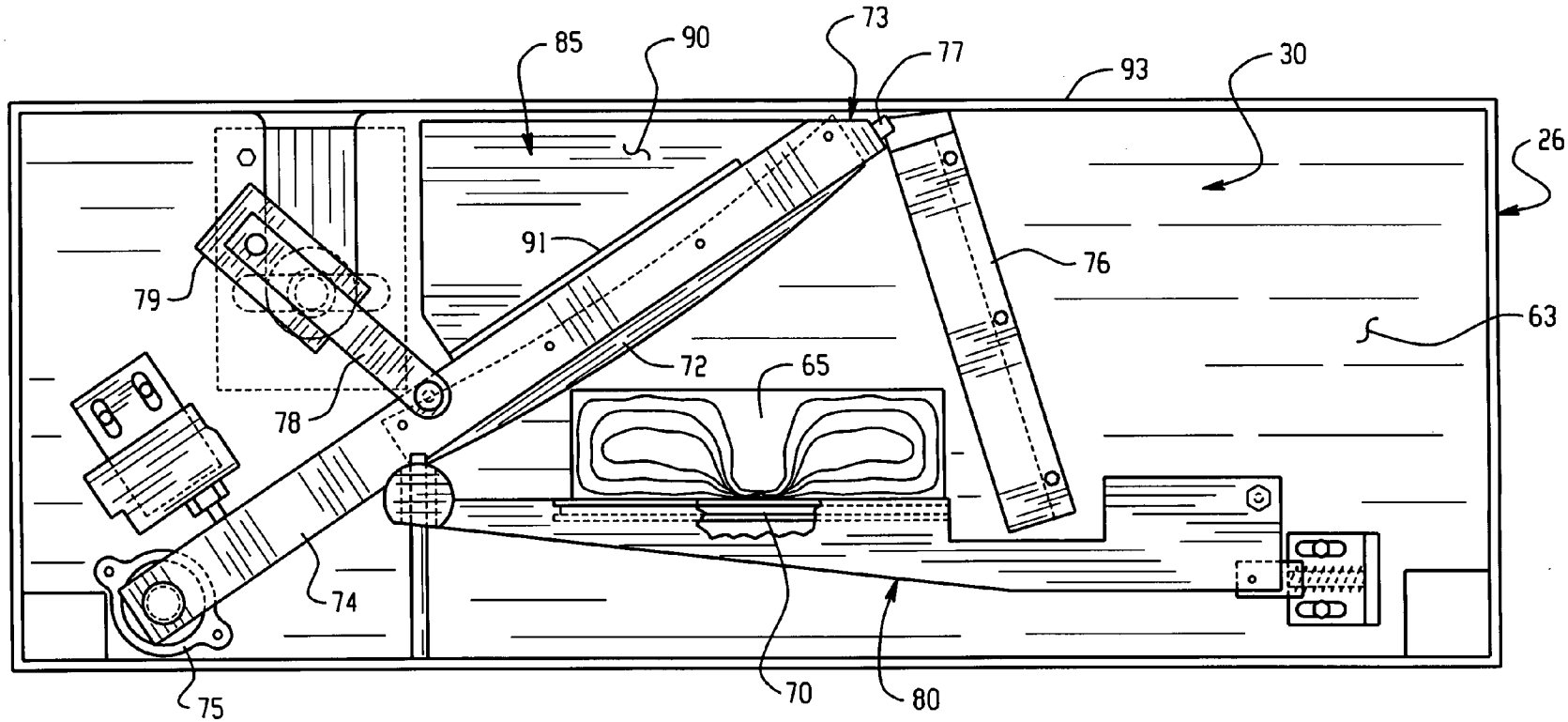
FIG. 4 is an end view of the machine, with an outer cover removed to permit viewing of a severing assembly in a fully retracted position of a moving cutting blade.

Details of the severing assembly 30 are shown in FIG. 4 where these components are illustrated isolated from the rest of the machine. The severing assembly 30 includes a stationary blade 70 and a moving blade 72, both of which are strategically positioned relative to the dunnage outlet opening 65. The blades 70 and 72 are the actual "cutting" elements of the severing assembly and coact in a scissor-like fashion to cut the dunnage strip into cut sections, or pads. The stationary blade 70 is fixedly mounted on the frame end plate 63 in such a manner that it is aligned with one side of the dunnage outlet opening 65, which for ease of description will be referred to as the bottom side of the outlet opening. The moving blade 72 is part of a moving blade unit 73 which includes a blade support member 74 on which the moving blade 72 is mounted. One end of the blade support member 74 is pivotally attached to the end plate 63 by, for example, a bearing block 75. The other or distal end of the blade support member 74 is slidably mounted on the end plate 63 within a slanted guide track 76. As is best seen by comparing FIGS. 4 and 5, this distal end of the blade support member 74 travels back-and-forth within the guide track 76 during a cutting cycle. A roller 77 may be attached to the end of the blade support member 74 to facilitate its travel within the guide track 76.

An intermediate (but not exactly central) part of the blade support member 74 is connected to a drive link 78 which is connected to a drive crank 79. A shaft (shown but not specifically numbered) is connected at one end to the drive crank 79. This shaft extends through the end plate 46 for connection by other drive components to the cutter motor 54 via the clutch 56. During operation of the severing assembly 56, the drive crank 79 is rotated so that the moving blade unit 73 travels between a retracted rest position and an extended full cut position.

The severing assembly 56 additionally may include an alignment device 80 which automatically "re-aligns" the cut section, or pad, with the dunnage outlet opening and the post-cutting guide chute during the return stroke of the moving blade unit 73. Details of the alignment device are found in U.S. Pat. No. 5,569,146.

Figure 5:
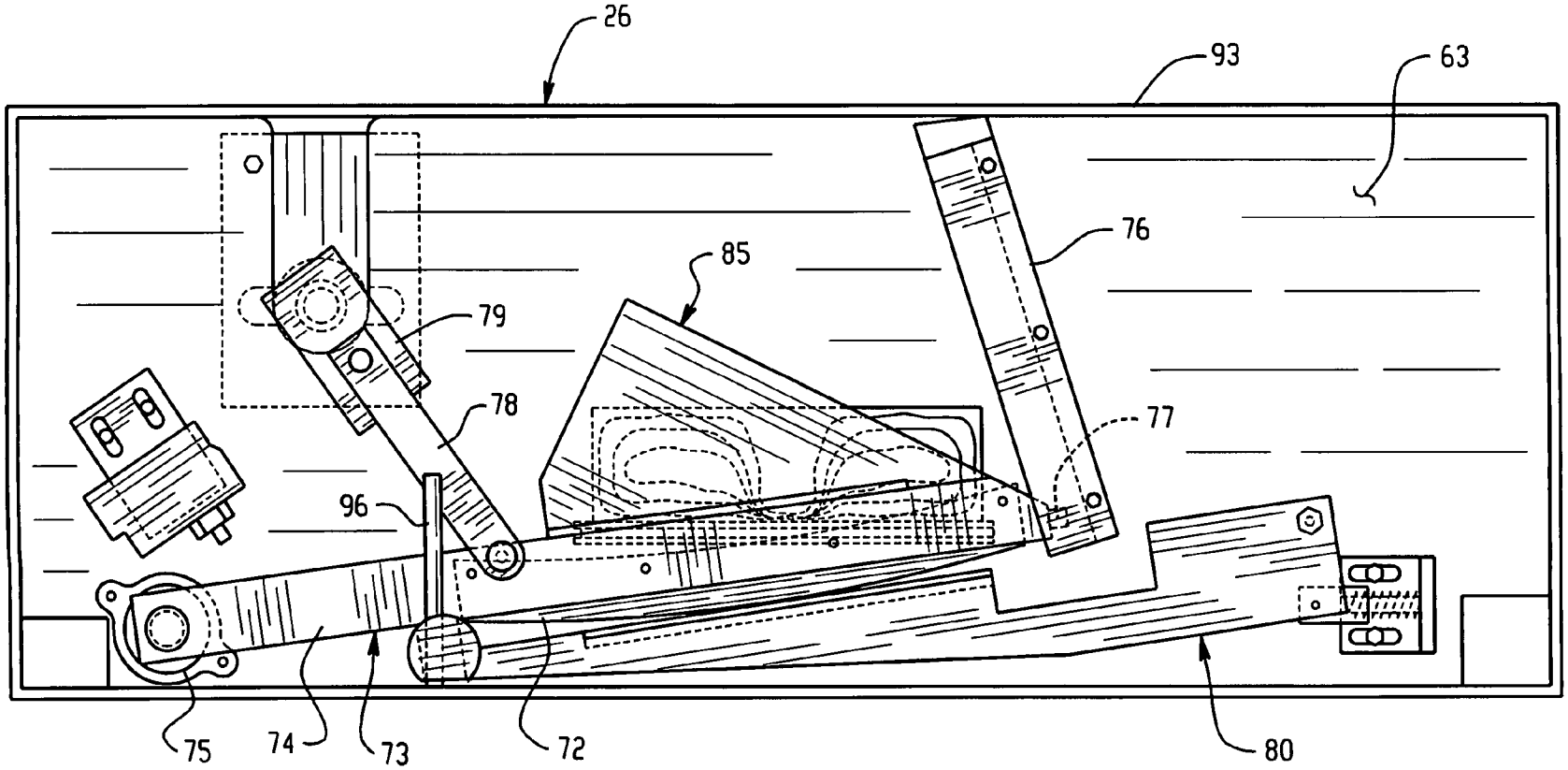
FIG. 5 is a view similar to FIG. 4, showing the cutting blade in a full cut position.

In accordance with the present invention and as illustrated in FIGS. 4–7, the moving blade has associated therewith a shutter 85. The shutter 85 moves with but trails behind the moving blade 72. The shutter cooperates with the moving blade to prevent the leading cut end of the continuous dunnage strip from moving "behind" the moving blade as the moving blade completes it cutting stroke, i.e., moves to its extended position shown in FIGS. 5 and 7. As seen in FIG. 5, the cutting blade when its extended full-cut position is almost substantially clear of the outlet opening. Heretofore, this allowed the cut end of the continuous dunnage strip 88 sometimes to move behind the moving blade after it has passed by and then interfere with the return stroke of the moving blade. Such movement of the cut end of the dunnage strip may arise from relaxation of the dunnage strip 88 particularly along the longitudinal axis of the dunnage strip. The shutter functions to block such movement of the cut end behind the dunnage strip, thereby to permit unrestricted return movement of the moving blade to its rest position.

Figure 6:
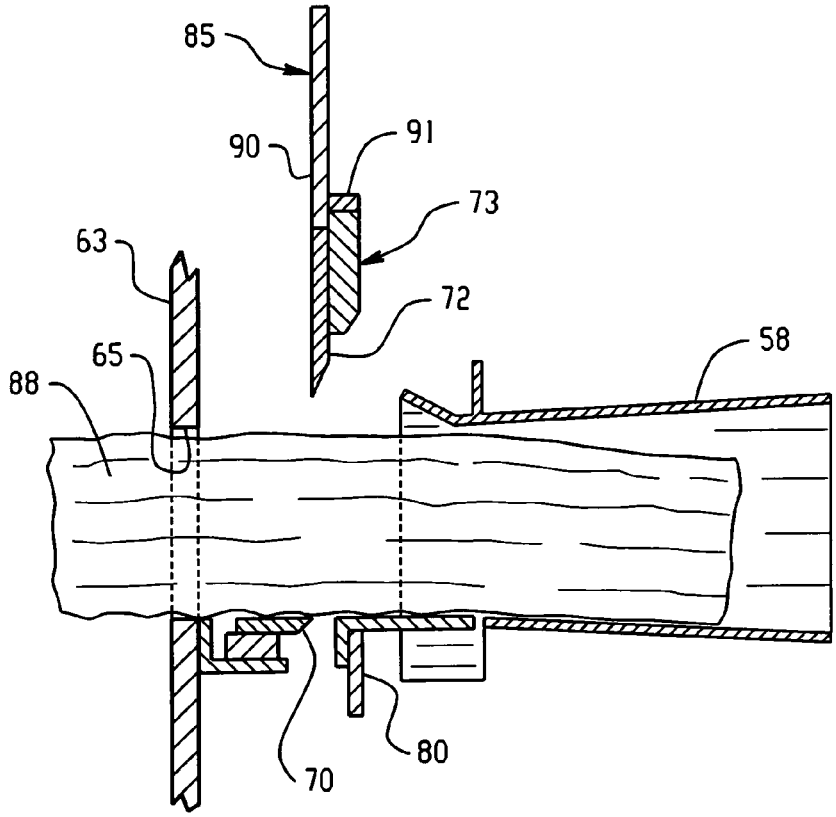
FIG. 6 is a cross-sectional view of the severing assembly showing the cutting blade in its fully retracted position.
Figure 7:
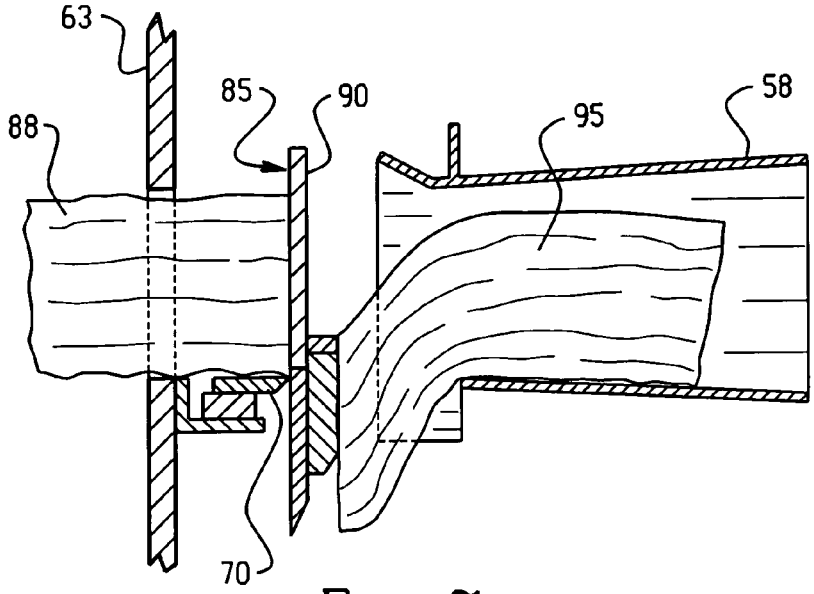
FIG. 7 is a cross-sectional view similar to FIG. 6, showing the cutting blade in its full cut position.

In the illustrated embodiment, the shutter 85 includes a shutter plate 90 that is attached at a mounting bar 91 to the back edge of the blade support member 74 by any suitable fastening means. The shutter plate is generally triangular in shape so as to fit within the envelope defined by the retracted position of the moving blade 72, the rest position of the crank 79 and link 78, and the top wall 93 of the housing 26. The shutter is also of sufficient size to substantially span the outlet opening when the moving blade is in its extended position, thereby preventing any movement of the cut end of the continuous dunnage strip behind the moving blade. As best seen in FIGS. 6 and 7, the shutter has an upstream side surface substantially flush with the upstream side surface of the moving blade. Preferably, the front edge of the shutter plates abuts the back edge of the moving blade to form an essentially continuous smooth surface against with the cut edge of the dunnage strip can easily slide as the cutting blade moves past it in either direction. As also shown in FIGS. 6 and 7, the front downstream corner of the blade support member 74 may be chamfered as shown to facilitate cutting of the dunnage strip 88 to form a cut section or pad 95.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A cushioning conversion machine for converting sheet stock material into a cushioning dunnage product, comprising a stock supply assembly which supplies stock material to be converted, a conversion assembly which draws the stock material from the stock supply and converts the stock material into a strip of cushioning, and a severing assembly for severing the strip of cushioning to form a pad, the severing assembly including a moving blade mounted for movement across a strip path between a retracted position and an extended position for cutting the strip, and a shutter movable with the moving blade for substantially blocking the strip path when the moving blade is in its extended position, wherein the shutter has an upstream surface flush with an upstream surface of the moving blade, and the upstream surface of the shutter is positioned to engage a downstream end of the strip when the moving blade is in its extended position.

2. A conversion machine as set forth in claim 1, wherein the shutter and moving blade are both mounted to a blade holder.

3. A conversion machine as set forth in claim 2, wherein the blade holder is mounted for swinging movement relative to another blade that coacts with the moving blade to cut the strip.

4. A conversion method for converting sheet stock material into a cushioning dunnage product, comprising drawing sheet stock material from a stock supply, converting the stock material into a strip of cushioning, and cutting the strip of cushioning using a moving blade to cut the strip of cushioning across a strip path between a retracted position and an extended position, wherein a shutter is moved in trailing relation to the moving blade wherein an upstream surface of the shutter is flush with an upstream surface of the moving blade and the upstream surface of the shutter smoothly slides along a downstream end of the strip of cushioning and engages the downstream end of the strip when the moving blade is in its extended position, for substantially blocking the strip path when the moving blade is in its extended position, thereby to prevent movement of a cut end of the strip from moving behind the moving blade as the moving blade slices through the strip of cushioning.

5. A conversion machine as set forth in claim 1, wherein the moving blade and shutter are separate components having common movement.

6. A conversion machine as set forth in claim 1, further including a second blade with which the moving blade coacts to sever the strip of cushioning.

7. A conversion machine as set forth in claim 6, wherein the second blade is a stationary blade.

* * * * *